US005643139A

United States Patent [19]

Stout et al.

[11] Patent Number: 5,643,139

[45] Date of Patent: Jul. 1, 1997

[54] CONTOURED LANDING SURFACE SYSTEM AND METHOD OF MAKING THEREOF

[75] Inventors: Roger Neal Stout, Huntington Beach; Troy Robinson, Villa Park, both of Calif.

[73] Assignee: Sport Supply Group, Inc., Farmers Branch, Tex.

[21] Appl. No.: 631,035

[22] Filed: Jun. 1, 1995

Related U.S. Application Data

[63] Continuation of Ser. No. 85,975, Jun. 30, 1993, abandoned.

[51] Int. Cl.[6] ..... A63B 6/00

[52] U.S. Cl. ..... 482/14; 482/23; 52/309.4; 5/724

[58] Field of Search ..... 482/14, 15, 23, 482/148, 27; 5/449, 420, 481, 450, 468; 52/309.4, 576, 577, 785, 809

[56] References Cited

U.S. PATENT DOCUMENTS

| | | | |
|---|---|---|---|
| 639,834 | 1/1899 | Gray | 5/420 |
| 3,220,151 | 11/1965 | Goldman | 52/309.4 |
| 3,323,152 | 6/1967 | Lerman | 5/468 |
| 3,513,491 | 5/1970 | Gordon | 482/23 |
| 3,892,402 | 7/1975 | Montour et al. | 482/15 |
| 4,215,857 | 8/1980 | Gordon | 5/420 |
| 4,498,477 | 2/1985 | Masuda et al. | 5/468 |
| 4,957,788 | 9/1990 | Colonet et al. | 5/785 |

FOREIGN PATENT DOCUMENTS

| | | | |
|---|---|---|---|
| 243352 | 6/1963 | Australia | 52/309.4 |
| 1178407 | 5/1959 | France | 5/468 |
| 507430 | 6/1971 | Switzerland | 52/309.4 |
| 1289515 | 2/1987 | U.S.S.R. | 428/23 |
| 1747095 | 7/1992 | U.S.S.R. | 482/23 |

*Primary Examiner*—Jerome Donnelly
*Attorney, Agent, or Firm*—David H. Judson

[57] ABSTRACT

A contoured landing surface system and a method of making thereof are provided. The system matches landing surface or pit density to the force generated by an athlete's descending body to cushion the athlete's fall based on air displacement rather than foam characteristics. The system is designed to compensate for variables such a velocity, mass and surface area at the point of impact by utilizing a multi-layer structure, each layer having a plurality of patterned ridges thereon and a network of air channels therebetween. The ridges and air channels of adjacent layers extend perpendicular to the ridges and air channels of each other. Preferably, the landing surface is constructed using layers of foam having the same density.

22 Claims, 2 Drawing Sheets

CONTOURED LANDING SURFACE SYSTEM AND METHOD OF MAKING THEREOF

This is a continuation of application Ser. No. 08/085,975 filed on Jun. 30, 1993, abandoned Sep. 5, 1995.

TECHNICAL FIELD

The present invention relates generally to landing surfaces for use in athletics and more particularly to landing surface systems which are capable of compensating for variables such as velocity, mass and surface area at the point of impact for each individual athlete.

BACKGROUND OF THE INVENTION

Landing surfaces or pits are well-known in the prior art. For example, it is well-known to construct a landing pit so as to decrease deceleration of the athlete's descending body in order to minimize or at least reduce risk of injury.

One construction well known in the art is the honeycomb structure. The honeycomb construction typically includes a piece of foam enclosed in a protective layer or cover. The foam has openings or holes in various positions which allow for displacement of air upon impact to break the fall of the athlete. However, the force of impact is absorbed in the landing surface at the point of impact rather than being distributed throughout the entire construction.

These structures have been insufficient due to "jarring effects" or "bottoming out" by the user. Attempts to remedy this problem have included constructing landing pits with a combination of foam sections or layers having various densities. For example, one foam section may be included for comfort, while another, having a different density, may be utilized to prevent the athlete from bottoming out. Still another channeled section having yet another density may be employed to regulate the flow of air that is expelled upon impact. However, such structures do not account for individual disparities in velocity, mass or surface area upon impact. Rather, prior art constructions have generally been constructed based on an average of variables of the typical users.

Consequently, slower and/or lighter athletes still experience a "jarring effect" as the landing surface does not expel enough air. In contrast, a heavier and/or faster athlete often experiences a feeling of "bottoming out". This is attributable to the athlete's surpassing the normal or average expectancy of foam compression. Similar problems occur in the area of high jump and pole vault events where there are substantial variations in heights descended from. Further, these structures do not provide a single density unit which is capable of both controlling deceleration, while simultaneously compensating for a multitude of variables on an individual basis.

Another disadvantage associated with the prior art occurs when two or more types of foam are laminated together. For example, typical prior art constructions utilize a lesser grade of foam having a smaller density as the top layer. For instance, a 1.2 $lb/ft^3$ top layer placed on 1.5 $lb/ft^3$ is available. However, the difference in foam properties frequently causes the top layer to degrade more rapidly than the underlying layer, thereby reducing the product life of the landing surface.

Still another disadvantage found in the prior art is the presence of large air channels in the structure. Large air channels lack accuracy and selectivity in displacing air. As a result of the larger openings or holes present in prior art constructions, deceleration and comfort of the athlete are sacrificed.

It would therefore be desirable to provide a single density landing surface system which is capable of compensating for many variables without the necessity of combining a variety of different density foam sections in order to overcome the problems associated with the prior art.

BRIEF SUMMARY OF THE INVENTION

The present invention provides a contoured landing surface system which achieves controlled deceleration of an athlete's descending body while simultaneously compensating for velocity, mass and surface area at the point of impact. The invention utilizes a multi-layer structure which includes a network of ridges and air channels designed to respond to the force generated by an athlete's falling body, thereby providing a smoother, safer and more comfortable landing than achieved using prior art techniques. As will become apparent below, it has now been discovered that a landing surface having smaller, but more numerous openings provides benefits over a surface having larger but fewer openings, even if the total volume for expelled air remains the same.

It is thus an object of the present invention to provide a contoured landing surface system.

It is another object of the present invention to provide a contoured landing surface which functions primarily based on the displacement of air rather than on foam characteristics.

It is yet another object of the present invention to provide a contoured landing surface which does not bottom out upon impact, yet compresses sufficiently to avoid a jarring effect to the user.

It a further object of the present invention to provide a contoured landing surface which completely and comfortably compensates for variables such as velocity, mass and surface area at the point of impact and automatically accounts for differences in such variables on an individual basis.

It is still a further object of the present invention to provide a single density landing surface system which ensures a smoother landing than honeycomb designs or multi-density structures.

It is still a further object of the present invention to provide a method of making a contoured landing surface system capable of accomplishing the aforementioned objects.

These and other objects of the invention are provided in a contoured landing surface system which includes a network of smaller and more numerous air channels than previously employed in traditional landing pits, mats and the like. Consequently, the smaller channels displace air more accurately and selectively, thereby ensuring a more comfortable and proper landing.

The landing surface is preferably used as both pole vault and high jump landing pits.

Preferably, the system is includes a multi-layer structure having a single density of approximately 1.5 $lb/ft^3 \pm 10\%$ and constructed from a foam block. In the most preferred embodiment, the foam block is encased in a cover which not only protects the foam block, but enhances the cushioning effect by regulating the flow of displaced air.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

Similar reference characters refer to similar parts throughout the several views of the drawings.

DETAILED DESCRIPTION

The present invention provides a single density contoured landing surface system suitable for a variety of uses. Preferably, the landing surface is used for athletic events. In the most preferred embodiment, the landing surface includes a multi-layer structure having a single density and is used as high jump and pole vault landing pits for controlling deceleration and ensuring a smooth and safe landing for the athlete. The contoured system of the present invention, however, is not limited to high jump and pole vault landing pits. The system may also be utilized during other activities such as landing surfaces for stunt work.

Figure 1:
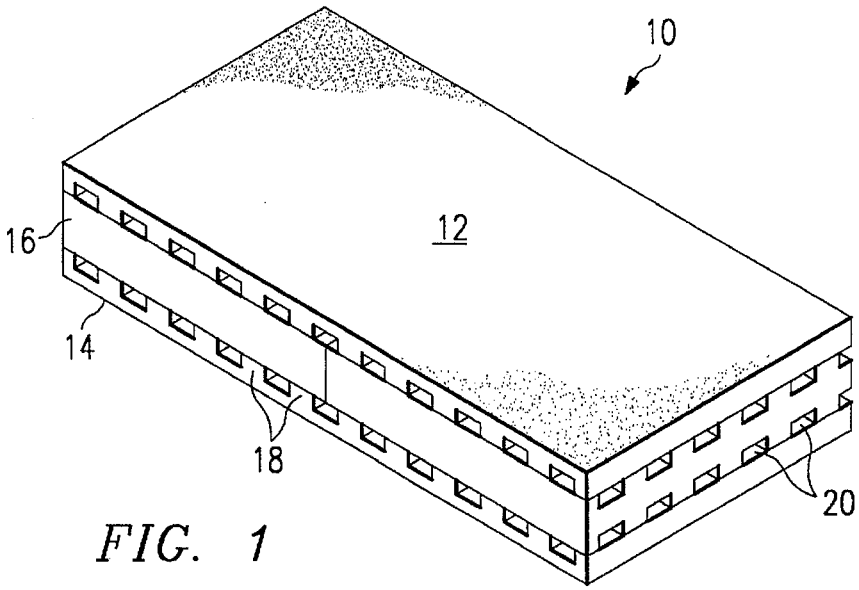
FIG. 1 is a perspective view of a contoured landing surface in accordance with the present invention.

The present invention provides smooth, safe landings by precisely matching landing surface or pit density to the force generated by an athlete's rapidly falling body. The landing surface thus accounts for variations in mass, velocity and surface area at the point of impact on an individual basis. FIG. 1 shows a landing surface prepared in accordance with the invention, preferably having a single density. A finished block 10 generally includes a top layer 12, a bottom layer 14 and at least one middle layer 16. The foam is preferably polyurethane and is commercially available from several sources. In alternative embodiments, further padding or support is provided by incorporating additional middle layers 16 or by omitting the top or bottom layer. Each of the layers 12, 14 and 16 are provided with a plurality of ridges 18, which form air channels or baffles 20 therebetween. The air channels 20 divide each of the foam layers, such that the finished product has a waffle-like construction.

Figure 3:
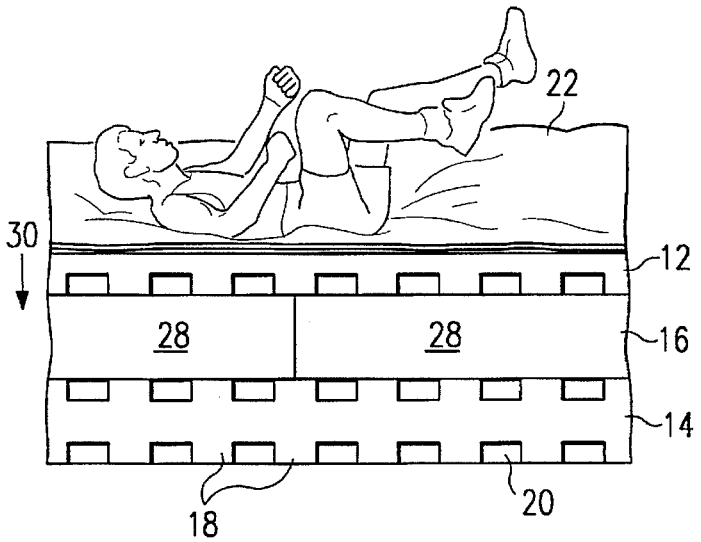
FIG. 3 is a side view of a contoured landing surface system illustrating the point of impact in accordance with the present invention.

Preferably, the top layer 12 is approximately six inches thick and air channels 20 are positioned to extend in an upward direction approximately three inches from the bottom surface of top layer 12. This construction is particularly advantageous when the landing surface of the present invention is used as a pole vault or high jump landing pit. The most basic construction includes a two-layer structure having a six-inch top layer and a twelve inch bottom layer, for a total of 18 inches of thickness. In a preferred embodiment, at least one ridge and one air channel are positioned within every twelve inches of each surface which has ridges and air channels formed thereon. While not meant to be limiting the following constructions are also suitable for use in accordance with the present invention: (1) a 24-inch thickness having two six-inch layers and a twelve-inch layer between, (2) a 30-inch thickness having a top layer of six inches and two 12-inch layers underneath (as illustrated in FIG. 3), and (3) a 36-inch thickness including six-inch top and bottom layers and two 12-inch layers positioned therebetween.

Prior art constructions generally employ a thicker top layer, thereby requiring more compression by the user prior to reaching the first air pocket. In contrast, the present invention only requires compression of about three inches of top layer 12 prior to contacting the first air pocket.

In accordance with the present invention, the air channels 20 form a network which includes generally smaller and more numerous air channels than those traditionally utilized. This is important since smaller, more numerous air channels having a volume V for air displacement will displace air at a greater velocity than a structure, such as a honeycomb construction, which has the same volume V but with larger, less numerous openings. As a result of the increased velocity, the displaced air is forced upwards at a greater pressure to provide a greater force against the athlete's body upon impact. Consequently, the athlete does not experience the level of stress as with the larger air channel constructions. The ability to displace air more accurately provides a landing surface which is capable of accommodating a wider range of users, while still maintaining a safe and comfortable landing surface. This is based on the functioning of the landing surface primarily based on air movement rather than on foam density.

Figure 2:
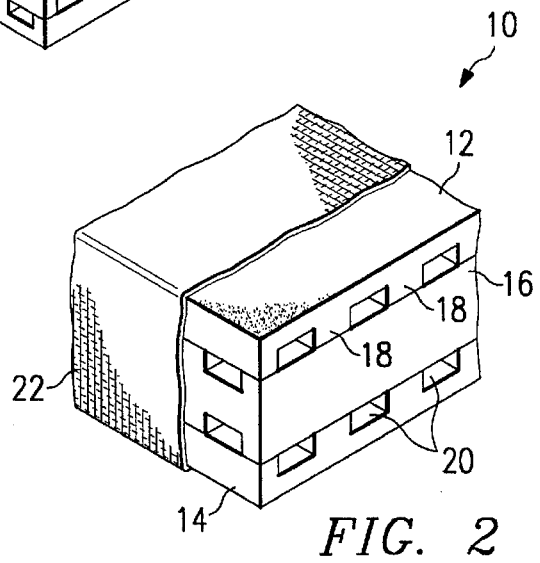
FIG. 2 is an end view of a landing surface and illustrates the contoured structure having air channels therebetween in accordance with the present invention.

Reference is now had to FIG. 2 in which one end of a foam pad construction prepared in accordance with the present invention is illustrated. As shown in FIG. 2, the air channels 20 and ridges 18 of each layer 12, 14 and 16 form a waffle-like construction. The block 10 is typically enclosed on the bottom and four sides in a protective casing or cover 22 formed of fabric such as PVC coated vinyl fabric, manufactured by and available from Cooley, Incorporated. The PVC coated vinyl fabric is a solid, non-breathable material having a base cloth which has been coated on both sides to prevent problems associated with moisture. The base cloth is a polyester fabric having a 5.3 oz. high tenacity 1000 denier which provides better results than the standard 840 denier nylon since nylon absorbs ten times the moisture that polyester will absorb at room temperature. Consequently, the strength of nylon is reduced by about 15% while the polyester remains unaffected. Additionally, while nylon has good initial strength, the coating process, the exposure to sunlight and moisture seriously reduce the integrity of the nylon. A cover 22, such as PVC vinyl fabric, is less likely to stretch out of shape or be affected by ultraviolet light (sunlight degradation). Thus, the cover 22 will maintain its original appearance longer and retain more of its performance integrity over extended use.

The top of cover 22 is preferably the only surface which is constructed of a breathable material. For example, a vinyl coated polyester fabric, such as Phifertex, is suitable for use in accordance with the present invention and is available from Phifer Wire Products, Incorporated. Phifertex is a breathable weaved mesh material having 35% open air space and which cleans easily with mild detergent and water. Phifertex is particularly well-suited for use in the present invention since each weave strand is individually coated and then weaved into a mesh. The mesh is then oven treated to bond weave cross points, thereby forming a tear-resistant, extremely durable fabric. Additionally, the PVC coating resists mildew. Further, chemical additives in the vinyl resist fading due to ultraviolet exposure. One of the advantages of using a construction wherein the only breathable surface is the top surface is that upon impact, air is displaced and forced in an upward direction such that excess air is expelled through the top surface. As discussed above, this provides additional comfort to the user rather than having air expelled through the side or bottom surfaces.

The preferred embodiment of the present invention is illustrated in FIG. 3 which shows the landing surface having a cover 22 with the side of the cover 22 removed for purposes of illustration. Generally, cover 22 encases all four sides of the block in addition to the top and bottom surfaces.

The landing surface functions as follows. Preferably, a 2 inch top pad (not shown in FIG. 3) is placed on top of the cover 22 such that the majority of force is transferred through the top pad onto the base unit as shown in FIG. 3. As force is imparted on the base unit or landing surface, top layer 12 is compressed in a direction shown by arrow 30 in response to the user's weight, velocity and impact surface area. The compression of layer 12 forces air out of air channels 20 positioned along the sides or the transverse axis of layer 12. The expelled air, which is forced outward and upward with a greater velocity and pressure as discussed above, then circulates to the top of top layer 12 and acts as an additional cushion to the athlete. Excess air is then expelled outside cover 22 through the breathable top material or other vents in the cover.

If the mass, velocity and/or impact surface area are great enough, top layer 12 will further compress in a direction as indicated by arrow 30 and contact middle layer 16 such that air is also expelled from channels 20 of the top and bottom surfaces of middle layer 16 located at the longitudinal ends of the block. Similarly, further force imparted upon the block will cause the block to compress and contact bottom layer 14, thereby forcing air out of channels 20 located in the transverse sides of the block on the top and bottom surfaces of bottom layer 14. Thus, the landing surface made in accordance with the present invention accommodates and automatically adapts to the individual user to eliminate "jarring" and "bottoming out" effects without any manual adjustments.

Although not required, the construction and placement of the layers used in accordance with the present invention enables the use of a single density foam system. This provides a distinct advantage over the prior art which includes filling a pit with a combination of different density foam sections. Another distinct advantage of the present invention over the prior art is the distribution of force of the athlete upon impact over the entire construction. A landing surface having a prior art honeycomb construction results in the athlete feeling the entire force of the foam thickness upon impact. Moreover, as the foam structure degrades, voids in the landing surface are experienced, thereby resulting in reduced comfort and even injury.

In contrast, the construction of the present invention distributes force upon impact over the entire construction and permits air to be expelled in directions 90° to one another to cushion the fall. Moreover, it has been discovered that an initial load deflection (ILD), which measures the pressure necessary to compress or penetrate a 4" foam sample 1", of 24 psi provides unexpectedly smooth and comfortable landings.

For example, the single density contoured system of the present invention is more efficient in controlling deceleration. Furthermore, when two or more types of foam are laminated together using prior art techniques, the product life is frequently reduced. The present invention, however, avoids this shortcoming by combining the single density block with the unique network of air passages channeled in two different directions. Thus, a consistently controlled deceleration is thereby achieved.

Further, landing surfaces constructed in accordance with the invention reduce fatigue experienced by athletes who use the pits for repetitious landings in a short period of time. This is attributable to the reduced stress ("jarring" or "bottoming out") experienced when using the landing surface of the present invention, thereby resulting in increased comfort and safety of the user. As a result, athletes can train longer and perform more repetitions before requiring a rest.

Figure 4A:
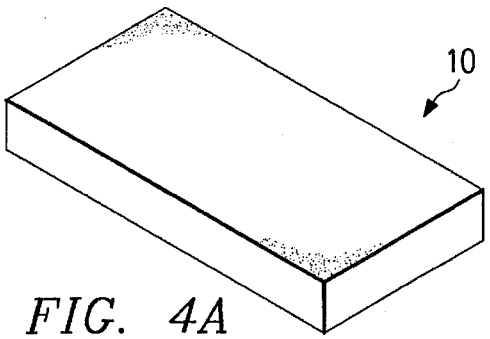
FIGS. 4A–4F illustrate a method of making a single density landing surface in accordance with the present invention.
Figure 4B:
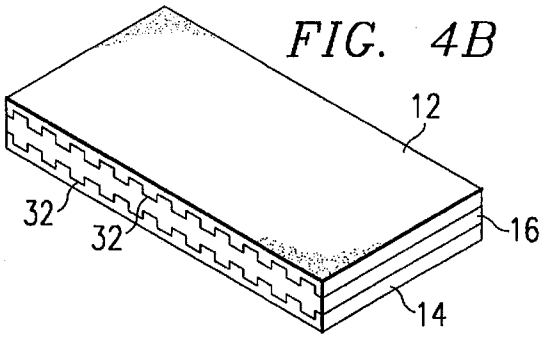

FIGS. 4A–4F illustrate a method of making a contoured landing surface system in accordance with the present invention. FIG. 4A shows an uncut block 10, while FIG. 4B depicts the block 10 cut with contours 32 to form bottom layer 14, top layer 12 and middle layer 16.

Figure 4C:
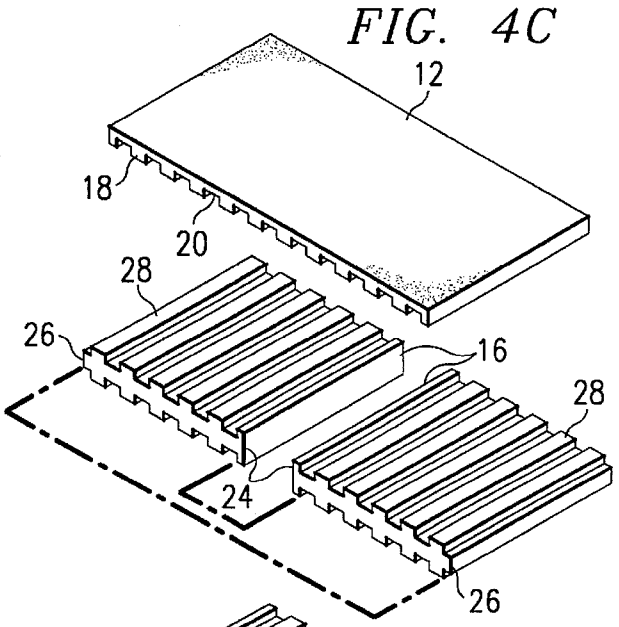
Figure 4D:
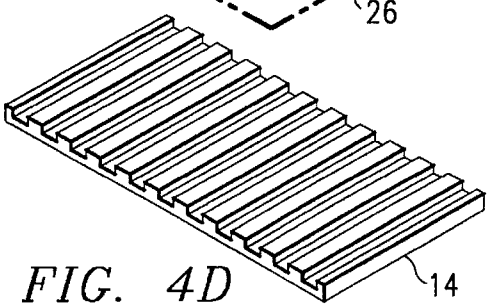

FIGS. 4C and 4D illustrate the layers separated from one another, such that contours 32 form ridges 18 and air channels 20 in each layer. FIGS. 4C and 4D also show middle layer 16, which has ridges 18 and air channels 20 on both the top and bottom surfaces, divided into middle pieces 28 such that each middle piece 28 has a first end 24 and a second end 26. In accordance with the present invention, middle pieces 28 are then rotated such that first ends 24 and second ends 26 contact each other and are each aligned adjacent to each other. The middle pieces 28 are then adhered to one another using adhesive or the like.

Figure 4E:
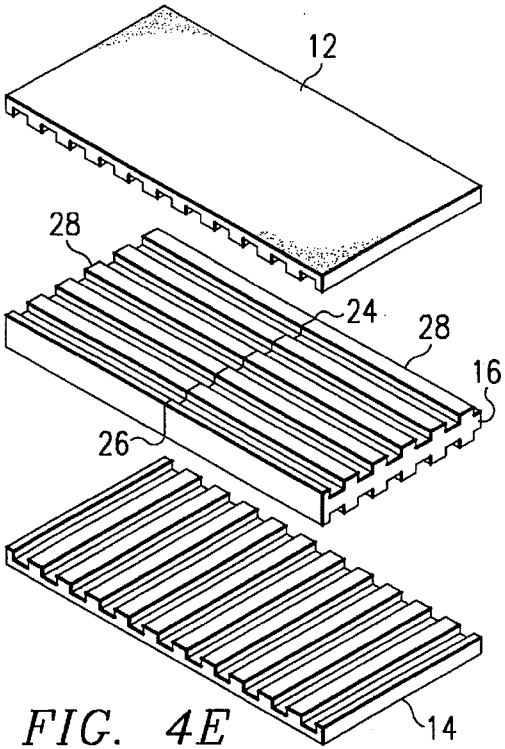
Figure 4F:
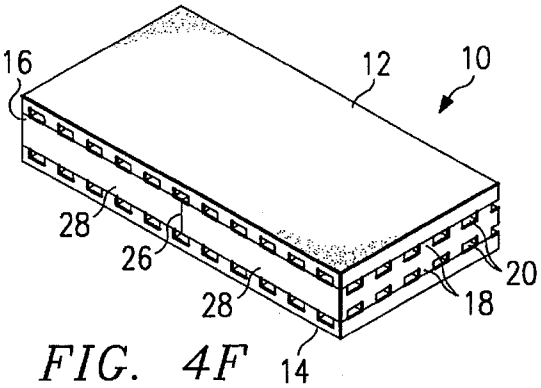

Layers 12, 14 and 16 are then joined together by placing the bottom of the middle layer 16 on top of the bottom layer 14 and then placing the top layer 12 over the top of the middle layer 16 as shown in FIG. 4E. The middle layer 16 thereby forms a waffle-like construction with the top and bottom layers.

While the first or top layer has ridges and air channels formed only on the bottom surface thereof, the second layer and any additional layers preferably include ridges 18 and air channels 20 on both top and bottom surfaces thereof. The layers are then attached and preferably adhered to one another. In the preferred embodiment, the adhesive is applied where the foam ridges contact each other. While not meant to be limiting, one type of adhesive which is suitable for use in the present invention is a hot melt adhesive manufactured by United Resin Products, Incorporated, which is available as Part No. 80-8392. This adhesive, having a viscosity of 500 cps. at 350° F., is applied to the structure at 375° F.

In an alternative embodiment of making a landing surface in accordance with the present invention, one or more layers are placed on top of each other in the following manner. Each layer has a plurality of ridges 18 formed thereon such that a plurality of air channels 20 are formed between each ridge 18. The ridges and air channels of one layer are positioned along a longitudinal axis while the ridges and air channels of the adjacent layer or layers are positioned along the transverse axis such that the landing surface, once formed, has a waffle-like construction, as discussed above. In this manner, it is possible to form a contoured landing surface having a single or multi-density layered structure which is still capable of functioning primarily based on air displacement.

It should be appreciated by those skilled in the art that the specific embodiments disclosed above may be readily utilized as a basis for modifying or designing other structures for carrying out the same purposes of the present invention. For example, it is within the scope of the invention to prepare a landing surface having a waffle-like construction which is suitable for use as evacuation safety devices from airplanes and the like. Such devices may be used as supplements to existing safety devices, in which case the landing surfaces may be stored on the ground for easy access during an emergency. Alternatively, the device may be compressed and stored on board an aircraft for immediate access. Similarly, the landing surface is adaptable for use for evacuating the lower floors of a burning building or for other emergencies requiring emergency evacuations. It should also be realized by those skilled in the art that such equivalent constructions do not depart from the spirit and scope of the invention as set forth in the appended claims.

What is claimed is:

1. A landing surface block for use in athletics having a longitudinal axis and a transverse axis, comprising:

a top layer formed from a single piece of compressible material having top and bottom surfaces, the bottom surface of the top layer having a plurality of ridges oriented along the transverse axis of the landing surface and defining a plurality of spaces therebetween;

at least one middle layer having top and bottom surfaces, each surface of the middle layer having a plurality of ridges oriented along the longitudinal axis of the landing surface and defining a plurality of spaces therebetween, the top surface of the middle layer positioned below the bottom surface of the top layer and attached thereto to define a first network of air channels along the longitudinal and the transverse axes of the landing surface between the top and middle layers;

a bottom layer formed from a single piece of material having top and bottom surfaces, the top surface of the bottom layer having a plurality of ridges oriented along the transverse axis of the landing surface and defining a plurality of spaces therebetween, the top surface of the bottom layer positioned below the bottom surface of the middle layer and attached thereto to define a second network of air channels along the longitudinal and the transverse axes of the landing surface between the middle and bottom layers;

wherein the first and second networks displace a volume of air in response to an applied landing force to cushion the applied landing force.

2. The landing surface block as described in claim 1 wherein the block is formed of foam.

3. The landing surface block as described in claim 2 wherein the foam is polyurethane.

4. The landing surface block as described in claim 1 wherein the first and second layers have the same density.

5. The landing surface block as described in claim 4 wherein the density is about 1.5 $lb/ft^3$.

6. The landing surface block as described in claim 1 further including a cover enclosing the block.

7. The landing block surface as described in claim 1 further including a cover enclosing the top, middle and bottom layers, the cover having side and bottom surfaces formed of a non-breathable material and a top surface formed of a breathable material, wherein compression of the top, middle and bottom layers expels air from the first and second networks upward through the top surface.

8. A landing surface for use in athletics having a longitudinal axis and a transverse axis, the landing surface comprising:

a first layer formed from a single piece of compressible material having top and bottom surfaces, the bottom surface having a plurality of ridges and air channels formed between the ridges, the ridges and air channels oriented along the transverse axis of the landing surface;

a second layer formed from a piece of single density material having top and bottom surfaces, the top surface having a plurality of ridges and air channels formed between the ridges, the ridges and air channels oriented along the longitudinal axis of the landing surface, the top surface positioned on the bottom surface of the first layer and attached thereto;

means for adhering the first layer to the second layer; and a cover enclosing the first and second layers, the cover having side and bottom surfaces formed of a non-breathable material and a top surface formed of a breakable material, wherein compression of the first and second layers expels air from the air channels and upward through the top surface.

9. A method of making a landing surface block having a longitudinal axis and a transverse axis including a first layer formed from a single piece of compressible material having top and bottom surfaces, the bottom surface of the first layer having a plurality of ridges oriented along the transverse axis of the landing surface and defining a plurality of spaces therebetween, comprising:

forming at least one set of contours in the block along the transverse axis to create first and second layers, each layer having top and bottom surfaces;

separating the first and second layers from one another such that the bottom surface of the first layer and the top surface of the second layer each have a plurality of ridges and air channels formed on the surfaces thereof, the ridges and air channels of the first layer positioned along the transverse axis;

separating the second layer into at least two pieces, each piece having a first end and a second end;

aligning the first ends of each piece, of the second layer and the second ends of each piece of the second layer such that the ridges and air channels of the second layer are positioned along the longitudinal axis; and placing the bottom surface of the first layer on the top surface of the second layer in the aligned position to form the landing surface.

10. The method as described in claim 9 wherein the block is formed of foam.

11. The landing surface block as described in claim 10 wherein the foam is polyurethane.

12. The method as described in claim 9 wherein the first and second layers have the same density.

13. The method as described in claim 12 wherein the density is about 1.5 $lb/ft^3$.

14. The method as described in claim 9 further including enclosing the block in a cover.

15. The method as described in claim 9 further including attaching the pieces of the second layer to one another in the aligned position.

16. The method as described in claim 9 further including attaching the layers together.

17. The method as described in claim 16 wherein the step of attaching includes an adhesive.

18. The method as described in claim 9 further including placing a third layer having top and bottom surfaces, the top surface having a plurality of ridges and air channels formed between the ridges positioned along the transverse axis, below the second layer.

19. A method of making a landing surface block having a longitudinal axis and a transverse axis including a first layer formed from a single piece of compressible material having top and bottom surface, the bottom surface of the top layer having a plurality of ridges oriented along the transverse axis of the landing surface and defining a plurality of spaces therebetween, comprising:

placing the first layer on a second layer having top and bottom surfaces, the top surface of the second layer having a plurality of ridges and air channels formed between the ridges and positioned along the longitudinal axis.

20. The method as described in claim 19 wherein the second layer comprises at least two pieces, each piece having a first end and a second end, the pieces aligned such that the first ends of each piece are adjacent to one another and the second ends of each piece are adjacent to one another.

21. The method as described in claim 19 wherein the first and second layers have the same density.

22. The method as described in claim 19 wherein the bottom surface of the second layer further includes a plurality of ridges and air channels formed between the ridges and positioned along the longitudinal axis.

* * * * *